US011105595B2

(12) United States Patent
Rastegar

(10) Patent No.: US 11,105,595 B2
(45) Date of Patent: Aug. 31, 2021

(54) HIGH FRAGMENTATION MORTAR SHELLS

(71) Applicant: Omnitek Partners LLC, Ronkonkoma, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 16/859,975

(22) Filed: Apr. 27, 2020

(65) Prior Publication Data

US 2021/0041215 A1 Feb. 11, 2021

Related U.S. Application Data

(60) Provisional application No. 62/840,334, filed on Apr. 29, 2019.

(51) Int. Cl.
*F42B 12/32* (2006.01)
*F42B 12/76* (2006.01)
*A63B 37/00* (2006.01)

(52) U.S. Cl.
CPC ..... *F42B 12/32* (2013.01); *F42B 12/76* (2013.01); *A63B 37/0006* (2013.01)

(58) Field of Classification Search
CPC ..... F42B 12/76; F42B 12/32; F42B 12/02; F42B 12/20; F42B 12/22; F42B 12/24; F42B 12/26; F42B 12/28; F42B 30/10
USPC ..... 102/492, 473, 477, 482, 490, 491, 493, 102/494, 495, 496, 497, 515, 516, 517
See application file for complete search history.

(56) References Cited

U.S. PATENT DOCUMENTS 6,484,642 B1 * 11/2002 Kuhns ..... F42B 12/24 102/493
8,973,503 B2 * 3/2015 Dunaway ..... F42B 12/24 102/495
9,738,947 B1 * 8/2017 Deshpande ..... C21D 1/06
2014/0182474 A1 * 7/2014 Dunaway ..... B22F 5/00 102/374
2018/0252508 A1 * 9/2018 Rastegar ..... F42B 12/24

* cited by examiner

*Primary Examiner* — John Cooper

(57) ABSTRACT

A mortar shell including: a polymer outer layer, the polymer outer layer having reinforcing fibers dispersed therein; and a metallic inner layer defining an interior of the mortar, the metallic inner layer having a plurality of metallic fragments, each of the plurality of metallic fragments having a shape to interlock to each of the other of the plurality of metallic fragments, the plurality of metallic fragments being assembled together into the metallic inner layer; wherein a first metallic fragment of the plurality of metallic fragments having a characteristic different than second metallic fragments surrounding and contacting the first metallic fragment.

11 Claims, 7 Drawing Sheets

HIGH FRAGMENTATION MORTAR SHELLS

CROSS-REFERENCE TO RELATED APPLICATION

This application claims the benefit of U.S. Provisional Application No. 62/840,334, filed on Apr. 29, 2019, the entire contents of which is incorporated herein by reference.

BACKGROUND

1. Field of the Invention

The present invention relates generally to mortars, and more particularly to high explosive fragmentation mortars.

2. Prior Art

A mortar system by its very nature needs to be light weight, low cost, and maneuverable. This restricts the ability to fire at longer ranges with greater accuracy since firing range and accuracy are a function of the size and weight of the system. Advanced technologies and methodologies have emerged that show promise in optimizing the launch and flight conditions of the mortar system to provide a more efficient sequence of launch and flight events, e.g., ignition of propellant, expansion of propellant gasses, travel of the mortar round up and out of the tube, ballistic flight, and terminal impact. The aerodynamic and flight characteristics can be modified to increase range and precision.

The conventional material used to construct the shell body of high explosive mortar rounds are steel-based alloys, forged steel, and wrought carbon steel. These metallic casings exhibit high mechanical modules, such as strength, ductility, and durability, and are relatively high in density. Fragmentation of metallic casings can be fundamentally categorized into one of three methods: natural, controlled (or embossed), and preformed fragmentation. Natural fragmentation of steel shells results to irregular and predominantly smaller fragments with low damaging capabilities.

Embossed fragmentation of metallic shells can be engineered by machining a grid layer to be placed between an unimpaired casing and the high-explosive material.

The lethality of fragmentation can further be improved upon by creating a matrix of preformed fragments embedded into the casing, although the integrity of the shell body will be compromised under the high launch accelerations experienced during the firing phase. The RAUG Company (now SAAB) overcame these difficulties when they introduced the Mortar Anti-Personnel Anti-Materiel (MAPAM) 60 mm mortar in 2004. The MAPAM round featured an epoxy matrix filled with 2400 ball bearings, enclosed between the metallic shell body and high explosive material. The preformed fragments featured in the MAPAM mortar increased lethality of the round by as much as 70% over conventional rounds that were in service at the time.

By replacing the conventional metallic casing with composite-based material, the propulsion acceleration level is increased during the firing due to the reduction of the mortar shell mass. In addition, the lethality of projected fragments and their covered range can be significantly increased by making the fragments lighter, thereby achieving higher expulsion velocities, and more aerodynamically shaped, thereby reducing drag forces acting on the fragments.

Composites are fabricated by combining two or more materials of different structures and compositions to yield tailored properties controlled by the orientation of fiber elements. Therefore, composites are typically categorized as anisotropic with mechanical properties that differ based on the direction of applied load. The implementation of composite materials, such as carbon-fiber reinforced polymers, into shell casing structure have been studied and tested over the past two decades, with applications focused primarily on: (1) non-lethal mortars, or (2) low collateral damage artillery rounds.

A study was conducted to determine the feasibility of implementing high module composite materials to meet the demanding mechanical requirements exerted onto mortar casings during the launch phase of a munition's flight path. The objective of the study was to develop technologies to deliver non-lethal payloads to areas of interest by inducing a fuzed ignition during the flight of a mortar bomb via case fragmentation. To achieve fragmentation at lower detonation energy levels, a casing structure was designed to fragment into eight small carbon-fiber resin strips by pre-stressing the composite structure during the fabrication process. A controlled fragmentation pattern can thereby be achieved with the resulting shell structure. While polyacrylonitrile (PAN) carbon-fiber (Hexel AS4-C plain weave) was determined to be the material of choice for the fiber structure, two other types of matrix materials tested were West System 105/20 and Epoxy System 303. The pan-based fibers were surface treated to promote adhesion between the fiber and the matrix, consequently increasing the interlaminar shear strength of the final composite. A vacuum assisted resin transfer modeling technique (VARTM) was utilized to create eight small strips of laminated carbon-fiber reinforced polymer with reduced voids and controlled curvature. The strips were then assembled into a cylindrical shape using a casing mold to be cured. Compression testing showed that the fabricated structure was capable of withstanding 9200 g's, while finite element analysis showed the buildup of stress concentrations along the corners of the individual laminated strips to initiate the desired fragmentation pattern, i.e., to break apart into eight strip fragments.

Composite material with filament winding has also been used to fabricate a non-uniform exterior casing of munitions. The process was used with the objective of developing a low collateral damage artillery shell so as to fabricate a composite munition shell body that would disintegrate into harmless fibers upon impact.

In a similar manner, composite warhead cased general purpose bombs have been developed in which a list of parameters, such as fiber and matrix types, winding tensions and laid patterns, as well as curing conditions were studied, to create an optimized structure capable of withstanding the exterior conditions of an effective weapon. A carbon-fiber-wound bomb body disintegrates instead of fragmenting, which adds explosive force nearby, but lowers collateral damage.

To mitigate the poor mechanical behaviors due to transverse loading of carbon-fiber composites, the manufacturing technique of filament winding is utilized to tailor desired mechanical properties as a function of winding angle to allow the exterior casing structure to sustain necessary loading parameters. Examples of filament wound exterior casings structures developed and implemented in artillery rounds are known in the art. Depending on the shell structures required loading parameters, the carbon-fiber filaments are wound at different angles to yield tailored stress resistances.

SUMMARY

High explosive fragmentation mortar embodiments are provided to significantly increase their range of coverage, accuracy, as well as their lethality.

The present high explosive fragmentation mortar embodiments (a) Increase range; (b) Increase lethality; and (c) Increase round stability, thereby targeting precision, while assisting range enhancement.

The high explosive fragmentation mortar embodiments replace the conventional metallic casing with a "hybrid" composite-based shell concepts that would not only reduce the total mass of the shell by an estimated 20-40 percent, but would also allow the shell to be constructed with novel highly stable and low drag metallic formed fragmentation layer that is load bearing during the firing, thereby not occupying any internal volume of the mortar casing. As a result, the mortar propulsion acceleration level is increased during the firing due to the reduction of the mortar shell mass. In addition, the lethality of projected fragments and their covered range is significantly increased by using highly stable and aerodynamically shaped formed fragments.

Unlike conventional all-steel bodies of a mortar where the entirety of the body assembly functions as lethal (natural) fragments upon dispersion, the hybrid shell body structure embodiments feature an external composite layer that would mostly disintegrate into relatively small and light fibers. Fragmentation layers would then provide for "controlled fragmentation" or "preformed fragmentation" functionality to provide for lethality. Embodiments use preformed fragment geometry with helical and tapered side surfaces so that the internal pressure due to detonation of the mortar explosives would induce dispersal of formed fragments to gain high spin rate, thereby achieving high stability and enhancing their area of effectiveness.

In addition to the reduction of the total mortar weight by the use of the hybrid shell bodies to increase the range, the aerodynamic drag forces acting on the mortar body can be reduced by providing patterns of dimples on the surface of the body and the retraction or discarding of a section of drag inducing portion of the fin once the round has gained stability following launch.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Embodiments for mortars include features for increasing one or more of their range and precision as well as their lethality. The mortar shell construction also provides the capability of integrating (embedding) components, such as multi-pulse actuation devices directly into the shell body, thereby significantly reducing the complexity and the number of components needed for their assembly into the mortar body.

Figure 1:
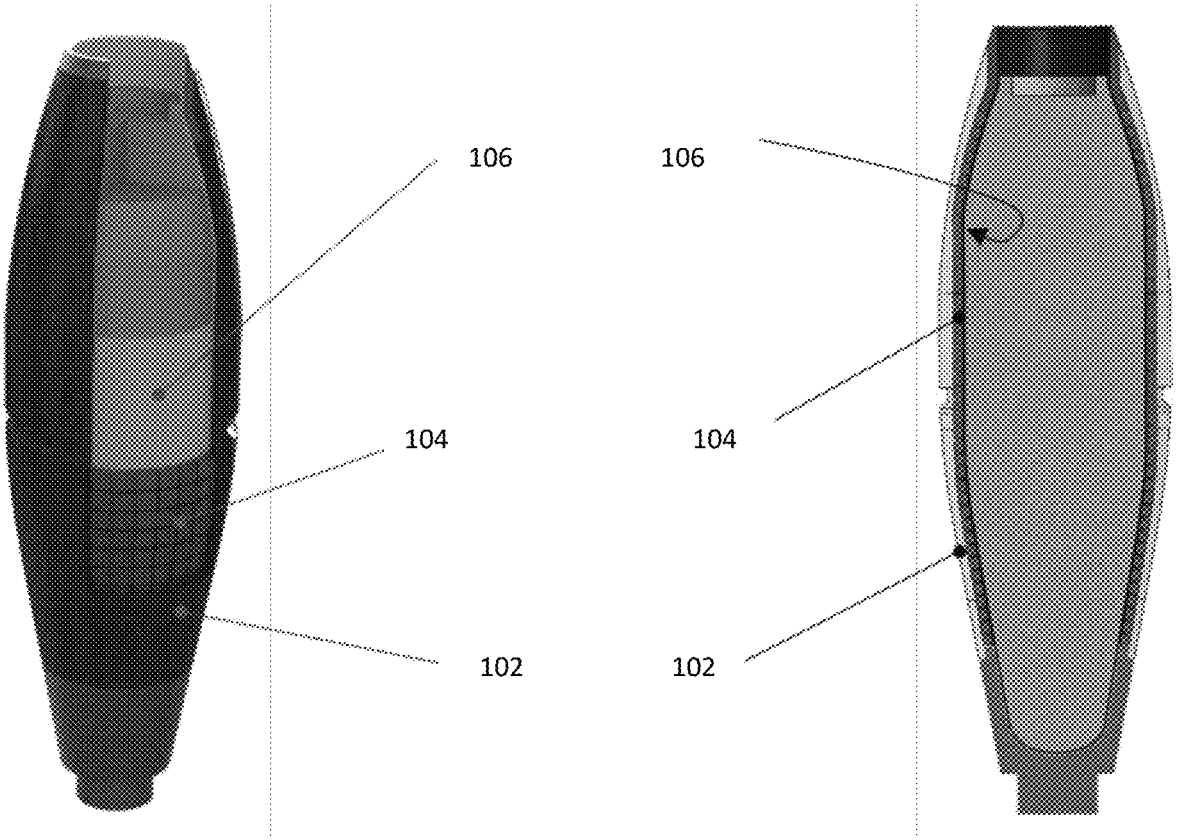
FIG. 1 illustrates an embodiment of a carbon-fiber composite shell with integrated formed aerodynamic fragments.

The hybrid shell body embodiments replace a portion of the conventional steel-based shell body structure with a hybrid structure with a significantly less overall mass, as shown in FIG. 1, thereby significantly increasing the projected mortar system range of coverage. In the hybrid shell body of FIG. 1, carbon fiber composite is used for this purpose due to its low density and high tensile strength. In this hybrid shell body, an outer carbon fiber layer 102 provides strength for tensile loading due to both high internal pressure and set-forward acceleration strength, and a high strength steel and compressive load-bearing fragmentation layer 104 provides compressive loading strength to withstand launch setback. As a result, a 32-37% reduction in the mortar shell body mass and thereby a 22-25% reduction in the total mortar assembly mass can be achieved.

In the hybrid type mortar shell body of FIG. 1, a relatively thin (e.g., 1-2 mm) high strength inner skin 106 may have to be provided in shell body to provide for added internal pressure resistance and to facilitate the munitions manufacturing process.

In the hybrid type shell body of FIG. 1, since the carbon fiber composite outer layer has been shown to disintegrate without generating lethal fragments upon detonation, the provided range enhancement via shell body mass reduction also requires considerations to enhance the lethality of fragmentation effects to yield an effective munition system. The hybrid type shell structure therefore includes the fragmentation layer 104 (composed of e.g., wrought carbon steel) that functions as both a compressive load bearing structure to withstand launch setback loads and as fragments when the mortar system detonates at an area of intended usage.

If the fragmentation layer 104 is partially severed with continuous notches to form a grid layer on an attached metallic surface, the mechanism of failure is said to be a controlled mode of fragmentation. When the fragmentation layer is assembled with an array of preformed pieces, the high strength internal skin 106 for preformed fragment stability may be required to provide for internal pressure generation and to facilitate its manufacturing process. In both cases, the filament wound carbon-fiber composite exterior shell 102 is required to provide strength for tensile loading due to the build-up of high internal pressure, and to resist failure due to set-forward acceleration as the shell structure travels out of the mortar barrel. A hybrid shell structure configured in this way to survive launch phase loads and resist failure due to the required internal hydrostatic pressure levels significantly reduces the total mass of the shell body and thereby the mortar round as described below.

Carbon-fiber composites are suitable for the construction of such hybrid shell body structures and have been successfully used in the construction of munitions due to its significantly lower density than steel but higher strength than wrought carbon steel. As an example, the material properties of a M55 unidirectional grade of carbon-fiber composite is shown in Table 2. This grade of carbon-fiber has high values of stiffness and strength in the fiber direction and poor mechanical behavior in the transverse direction and is one of the higher density grades of carbon-fiber composite material. As can be seen in Table 2, despite being a higher density grade, it is still more than four times less dense compared to conventional wrought carbon steel. The M55 unidirectional grade of carbon-fiber composite also has elastic moduli and Poisson's ratios that are compatible with steel.

TABLE 1

Comparison of wrought carbon steel and M55 UD high modulus carbon-fiber.

| Material Properties | Wrought Carbon Steel | M55 UD Grade, Carbon Fiber [0°] * |
|---|---|---|
| Density (g/cm$^3$) | 7.88 | 1.91 |
| Elastic Modulus (GPa) | 210 | 300 |
| Tensile Strength (MPa) | 400-550 | 1600 |
| Compressive Strength (MPa) | 170-310 | 250 |
| In-Plane Shear Modulus (GPa) | 74-82 | 5 |
| Poisson's Ratio | 0.29 | 0.3 |

* In the transverse direction, the elastic modulus and tensile strength is 5 GPa and 50 MPa, respectively.

The hybrid shell body embodiments include "controlled fragmentation" or "preformed fragmentation" layers 104 of various geometries. Such layers 104 can achieve significant shell body mass (of the order of 20-40 percent) without compromising the shell strength to withstand the maximum firing setback acceleration and the required internal hydrostatic pressure. Such layers 104, particularly those constructed with "preformed fragmentation" layers, achieve significantly increased lethality due to the use of highly stable and reduced drag fragments—with possible induced spin—to increase their coverage and effectiveness.

Figure 2B:
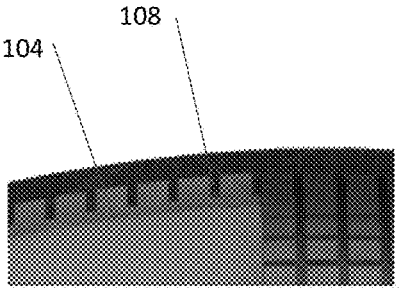
FIGS. 2*b* and 2*c* illustrate controlled and preformed fragmentation, respectively.
Figure 2C:
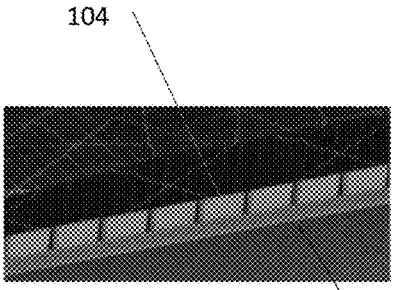
Figure 2A:
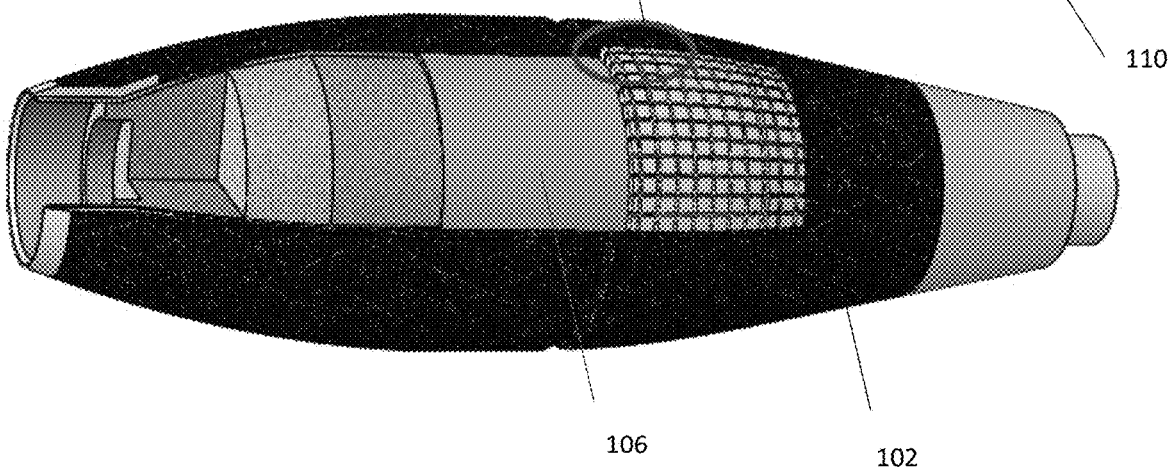
FIG. 2*a* illustrates a hybrid shell body structure of a mortar.

A solid model of a hybrid shell body of the type shown in FIG. 1 is shown in FIGS. 2*a*-2*c* to illustrate the shell body structure with "controlled fragmentation" and with "preformed fragmentation" layers 104. It is noted that the term controlled (or embossed) fragmentation implies that the fragmentation layer has grooves 108 to induce the desired pattern of fracture to produce fragments of the desired geometries, FIG. 2*b*. In shell bodies with a controlled fragmentation layer 104 the solid (un-grooved) base 110 of the layer functions as the inner skin, FIG. 1, to resist fracture due to the buildup of internal hydrostatic pressures. In contrast, the term "preformed fragmentation" layer implies the usage of preformed fragment pieces that are held in place between a relatively thin inner skin layer and the carbon fiber outer skin of the shell body, FIGS. 1 and 2*c*.

It is noted that in FIG. 2*c*, an exaggerated spacing between the formed fragments is provided only to emphasize their separation and in practice, the fragments are expected to either be essentially in full contact (with or without a very low tensile load bearing filler) to support axial compressive loads due to the firing setback acceleration.

The material utilized for shell body construction for a conventional mortar round is wrought carbon steel. For the construction of the hybrid shell body structure concepts, wrought carbon steel can be used for controlled fragmentation concepts and higher strength alloy steel for preformed fragmentation concepts. In the controlled fragmentation configuration, since the grooves are partially cut into the structure, the remaining material acts as the internal layer provided in the preformed fragmentation concepts to provide the necessary strength to resist the buildup of internal pressure due to the ignition of the energetic material contained within. For preformed fragmentation configurations, a separate inner skin, such as high strength steel, can be used to minimize its required thickness, is provided to resist the required internal pressure levels. The inner skin 106 also serves to facilitate assembly of the preformed fragments. Both controlled and preformed fragmentation concepts have an exterior layer 102 created by winding filaments of carbon-fiber composites and/or fabricating a pre-impregnated layer of composite fibers in a thermoset polymer matrix material, to provide the necessary tensile load bearing functionality of the exterior composite casing.

As was described previously, in present hybrid mortar shell bodies, and from a structural strength point of view, the carbon fiber outer skin is provided mainly for tensile and hoop strength, while the fragmentation and the inner skin (when used) provides axial strength.

Figure 3:
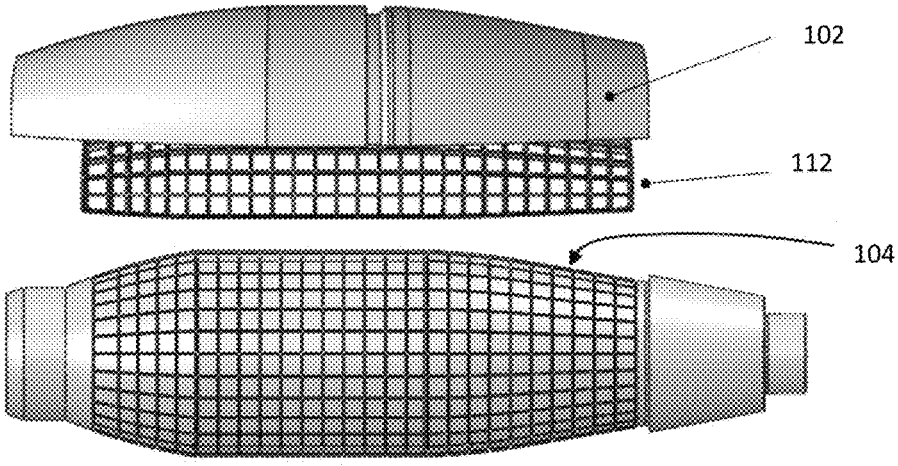
FIG. 3 illustrates a solid model of a hybrid mortar shell body with a uniform thickness controlled fragmentation layer with scoring cuts.

FIG. 3 illustrates a hybrid mortar round in which an offset feature is used to create a uniform controlled fragmentation layer 104 of wrought carbon steel that is 6 mm thick. The scoring depth in the fragmentation layer is made to be 1 mm deep (16.7% of the thickness of 6 mm). The mortar round of FIG. 3 is shown without its inner skin. The scored cuts in the fragmentation layer were filled with a high compressive stiffness but low tensile stiffness material 112, such as epoxy with high glass powder filler, which can be in lubricant sprayed scored surfaces to minimize surface adherence. Lastly, carbon fiber composite outer skin 102 is provided for the remaining thickness profile of the shell body assembly.

It is noted that the tensile stresses due to internal hydrostatic pressure loading might fracture the controlled fracture layer along the scored cuts, however, the exterior carbon fiber composite skin supports the pressure loading. It is also appreciated that if the possibility of controlled fragmentation layer fracture along some of the scored cuts is desired to be prevented, a thin (for example, 1 mm thick) high strength steel inner skin 106 can be added to the shell body as shown in FIG. 1, which would effectively make the resulting hybrid shell body to function very much like the hybrid formed fragmentation shell body described below.

It is noted that in the prior art rounds a significant amount of explosive energy is consumed in the process of plastically deforming and fragmenting the metallic casing and tearing apart epoxy matrix surrounding the preformed balls. Thus, by replacing the metallic casing with the previously described carbon fiber composite outer skin, FIG. 1, and eliminating the epoxy matrix filler, the propulsion forces acting on the formed fragments and therefore their range and lethality is significantly increased.

In the preformed fragmentation concepts described below, the preformed fragments have specific geometries that allow them to fill the entire layer volume of the fragmentation layer, thereby leaving maximum internal volume for high explosive charges. This contrasts with the preformed ball fragments of the prior art rounds, which leaves a considerable space between the balls that is filled with epoxy material. Therefore, the preformed fragmentation embodiments provide for significantly higher lethality due to larger lethal coverage, as the mortar round is provided with higher explosive energy while eliminating any unnecessary drag due to the adhesion of the epoxy filler on the surface of the dispersed fragment.

The hybrid shell body embodiments with preformed fragmentation layers can have the following two features: (i) a separate thin inner skin layer of higher strength steel is provided as shown in FIG. 1 to resist internal hydrostatic pressure and to facilitate the shell body fabrication, and (ii) the preformed fragments are compressive load bearing to support setback acceleration loading. The carbon fiber composite outer skin as well as the inner skin high strength steel layer provide the required tensile load bearing functionality to mitigate the set forward acceleration (if significant) and to allow build-up of internal pressure to the desired level during the round detonation.

Figure 4:
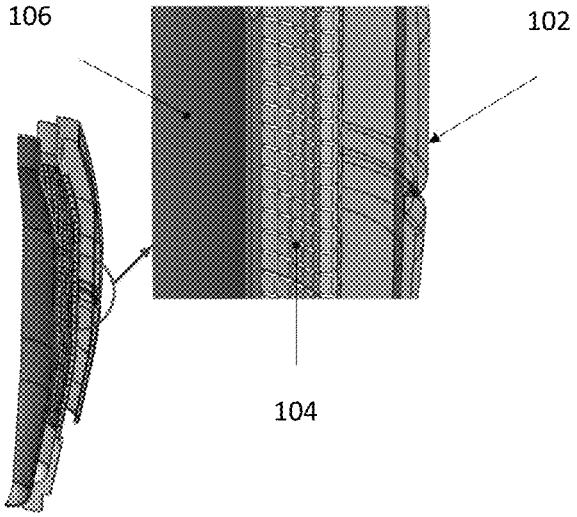
FIG. 4 illustrates cut-away and exploded views of a hybrid shell body having preformed fragmentation embedded in-between a thin high strength steel inner skin layer and a carbon fiber composite outer skin exterior layer.

A simplified hybrid shell body with preformed fragmentation layer 104 is illustrated in FIG. 4. An exploded view shows the preformed fragments as embedded in-between the thin high strength steel inner skin 106 and the carbon fiber composite outer skin 102. It is noted that in FIG. 4, a gap is shown between the preformed fragments only for the purpose of facilitating visualization of their geometrical shape, but in actuality, the preformed fragments are considered to be essentially touching, with any gaps having been filled with a high compressive stiffness but low tensile stiffness material, such as epoxy with high glass powder filler, which can be with the adjacent surfaces of formed fragments having been covered by certain low friction lubricant such as graphite. The formed fragments can therefore be essentially considered to be suspended within the aforementioned inner 106 and outer 102 layers.

The hybrid shell body assembly embodiments for controlled and preformed fragmentation have been found to achieve 36.6% and 31.9% reduction in the mass of the shell body, respectively. An estimated total mass reduction of 24.93% and 21.74% relative to a conventional fully assembled cartridge was also determined for the scored and preformed embodiments, respectively.

The disclosed fragments are stable during flight of the mortar round and induce relatively low drag. The formed fragments are configured to be compressive load carrying but provide minimal resistance to separation via internal pressure induced by round detonation. The method of reducing drag using proper patterns of surface dimples can also be used to induce a desired spin rate to enhance mortar round stability and thereby accuracy.

Also provided are embodiments for enhancing lethality of the hybrid shell body described above. Unlike conventional all-steel bodies of a mortar where the entirety of the shell body functions as lethal fragments upon dispersion, the hybrid shell body structure features an external composite skin that functions primarily to resist tensile stresses to allow build-up of internal pressure to the required level during detonation and to constrain the embedded preformed fragments within the body assembly.

The embodiments are intended to provide for large number fragments without sacrificing the internal volume of the mortar shell body and to increase lethality of the fragments and to maximize their area of effectiveness (AoE). Detailed designs to illustrate preformed fragment patterns are provided to enable the fragmentation layer to bear the necessary compressive loading during the launching phase. If required, an interlocking pattern to provide for both compressive and tensile load bearing is also provided. Fragment geometry optimization can be provided for preformed fragments to induce spin effect onto the dispersing fragments to increase their stability during the flight and reduce drag forces.

Figure 5:
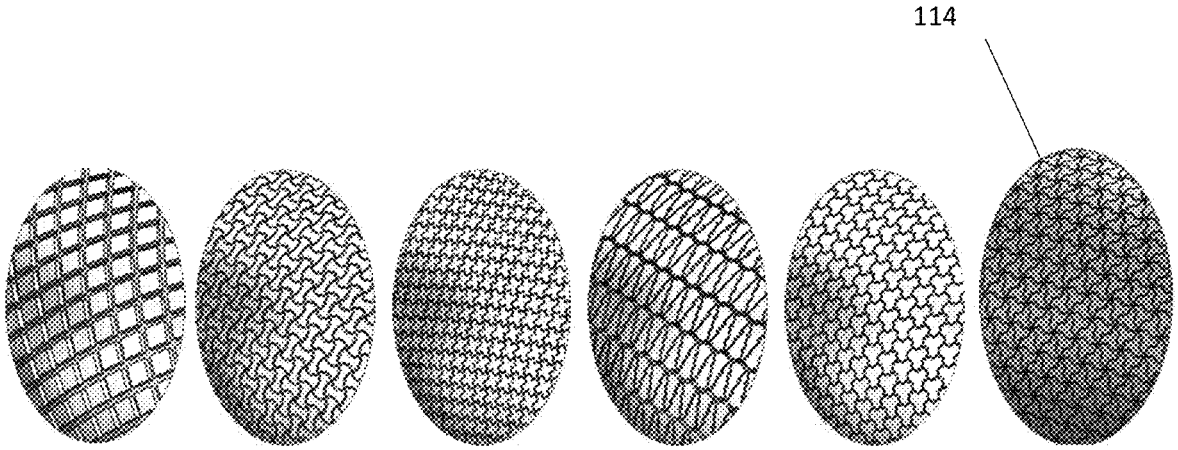
FIG. 5 illustrates example configurations of a portion of planar geometrical features for compressive load bearing preformed fragments embedded in a hybrid body assembly.
Figure 6:
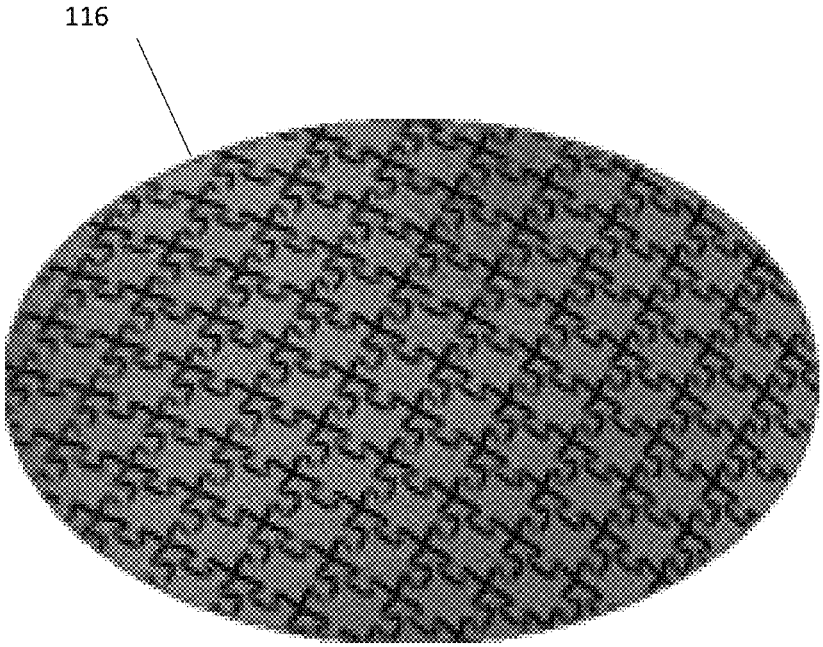
FIG. 6 illustrates a portion of an interlocking planar geometrical pattern of preformed fragments embedded in a hybrid body assembly that is capable of withstanding both compressive loads and tensile loads.

The variations in the possible preformed fragment geometrical patterns are configured to be repetitive in nature, so that considerations for manufacturing and assembly issues and cost can be minimized. Due to the complex behavior of explosives in a quasi-static detonation cycle, the pattern designs are intended to have the greatest chance of avoiding unnecessary drag as they disperse through the air in the small window of time after the mortar shell detonates. Shapes of the fragments may be similar to shuriken, a form of Japanese concealed weapon that was traditionally thrown towards opponents to induce an open wound via a slashing action. Each configuration was created with a planar feature that allowed the neighboring fragments to lock in place to bear the necessary compressive loads, as shown in FIG. 5. Considerations were also made for scenarios where tensile integrity from the fragmentation layer was needed to relieve stress intensities acting on the exterior composite layer during set forward action. A jigsaw puzzle-like pattern 116 with interlocking featured (male and female contours) on two adjacent planes is illustrated in FIG. 6 and is an example of a planar pattern that would contribute both to compressive and tensile load relief in the mortar body assembly.

The planar patterns of the fragments are only one aspect that can contribute to the load bearing capability and the stability of the fragments after dispersion. Another aspect to consider are the surface features, which is defined as radial depth profiles of each preformed fragment. To illustrate this concept, the right-most planar pattern 114 shown in FIG. 5 (hereinafter referred to as the lambda [λ] pattern 114) will be used to demonstrate the initial phases of surface feature design optimization. In this preformed fragment configuration, helical surfaces with a relatively shallow pitch angle are provided on the three side of the fragments 118 along their radial depth as shown in FIG. 7, giving the formed fragment 118 air-screw (propeller) like features.

An embedded assembly of such preformed lambda patterned fragments 118 an appropriate pitch angle (as an angle of attack in the corresponding air-screw) would be forced to spin as they are propelled outward due to the generated pressure wave due to the round detonation as described in more detail below. During their flight, the air-screw (propeller) like features of the spinning fragments 118 will generate a forward propelling force (i.e., axial aerodynamic forces or lift), while giving the fragments 118 stability against tumbling and minimizing drag forces acting on the fragments. This configuration is illustrated in FIG. 7 by an array of identical preformed fragments 118 arranged in two different orientations to induce "one-directional" spin on the dispersed fragments. By providing helical surfaces, as shown in FIG. 8, following detonation, the formed fragments 118 would spin in two opposite directions ("two-directional").

Figure 7:
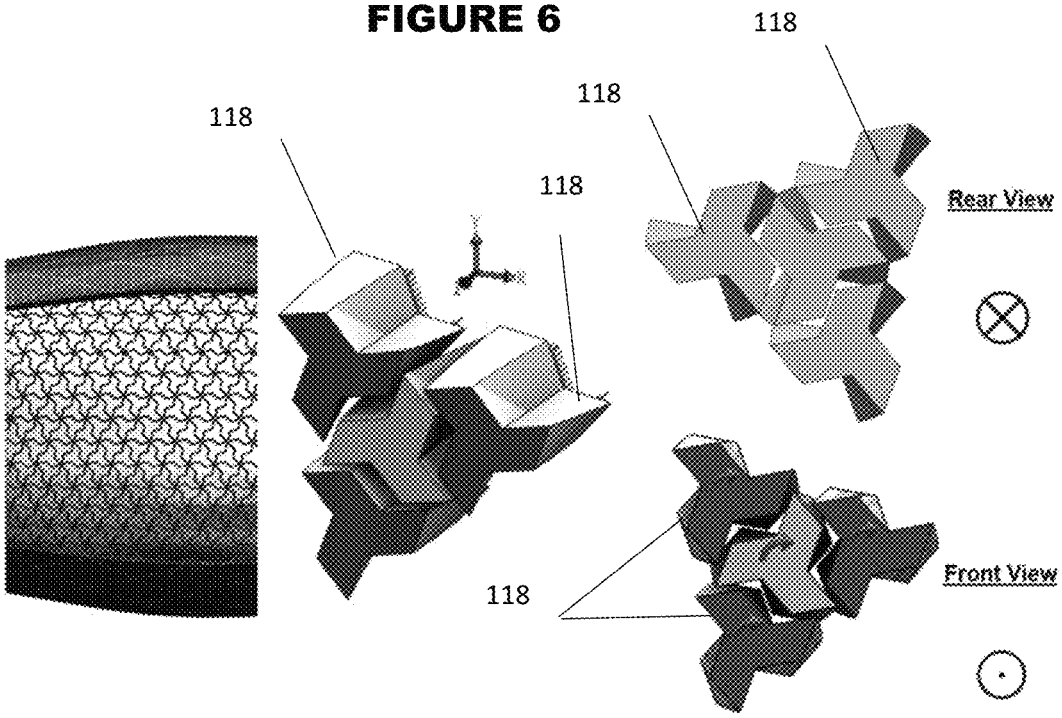
FIG. 7 illustrates formed fragments with helical side surfaces to form "air-screw" type spinning fragments, arranged for "one-directional" (spin in the same direction) spinning.
Figure 8:
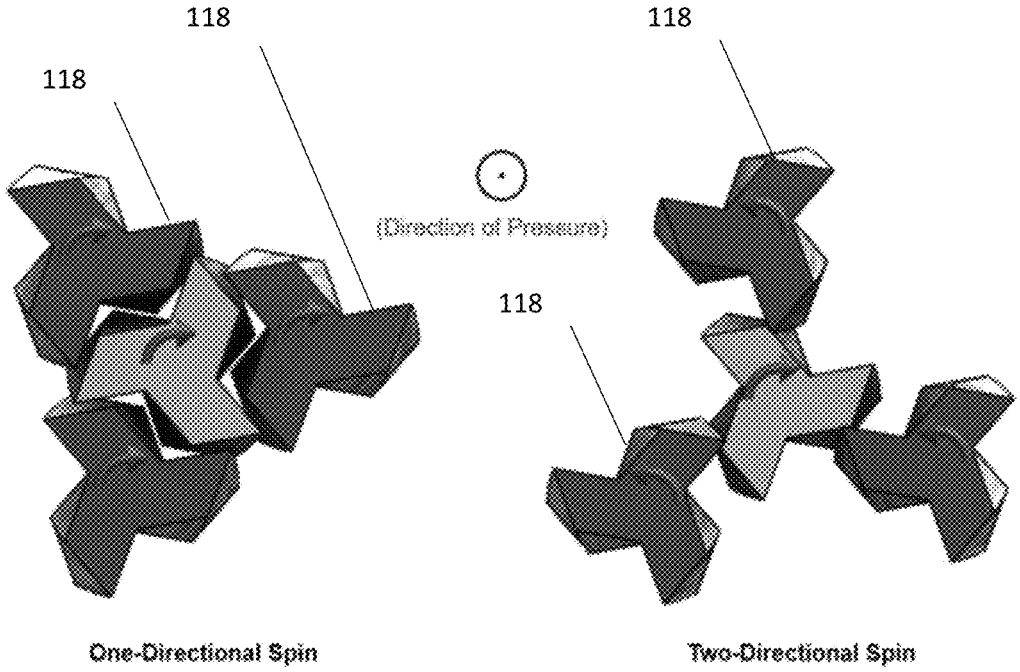
FIG. 8 illustrates formed fragments with helical side surfaces to form "air-screw" type spinning fragments, with the same (left) and two opposite spin directions (right).

In the formed fragment geometry design concepts of FIGS. 7 and 8, the pressure generated from the detonation of the explosive material inside the mortar shell body assembly act on the interior surface of the preformed fragments. To further increase surface-to-surface contact, the helical surfaces of the neighboring preformed fragments 118 are provided with a draft angle so that contact between the surfaces is maintained as the fragments are radially displaced during the dispersion process. The draft angle (taper) is implemented onto the helical surfaces 118*a* provides for groups of formed fragments with larger surface areas (Area 1) facing the interior volume of the mortar shell body, with groups of formed fragments with smaller surface areas (Area 2) facing the interior volume of the mortar shell body surrounding them. This difference in interior surface areas translates to a change in applied radial force acting on the internal surfaces 118*b* of the formed fragments 118 due to the internal pressure generated by the detonation of the mortar explosive material. Thus, the preformed fragments would displace radially outwards at different velocities, i.e., those formed fragments 118 with larger interior surface areas are pushed out of the formed fragmentation layer sooner than the remaining formed fragments.

This differential radial velocity between the formed fragments 118 causes the helical contacting surfaces 118*a* to exert spinning torques on each other and depending on: (a) the amount of difference in the velocities of the adjacent formed fragments 118; and (b) the pitch angle of the helical surfaces 118*a*, a final spin rate is induced on the formed fragments 118 at the start of their free flight.

It is appreciated that relatively simple changes in the overall geometry and mass of the formed fragments in the fragmentation layer of the type presented in FIGS. 7 and 8 can be used to vary the resulting spin rate of the dispersed formed fragments 118. For example, the following methods can be used to significantly increase the formed fragment spin rates:

1. By increasing the pitch angle of the helical side surfaces 118*a* of the formed fragments 118 (with the maximum pitch angle possible usually being around 6-8 degrees to minimize jamming friction forces);

2. By making the formed fragments 118 with a larger internal surface area (Area 1) to be lighter in mass than its surrounding formed fragments 118, thereby being accelerated radially out at higher rates;

3. By making the formed fragments 118 with a larger internal surface area (Area 1) than the surrounding formed fragments 118, thereby increasing the pressure induced radial force that acts on the formed fragment 118, thereby causing it to be accelerated radially out at higher rates.

Figure 9:
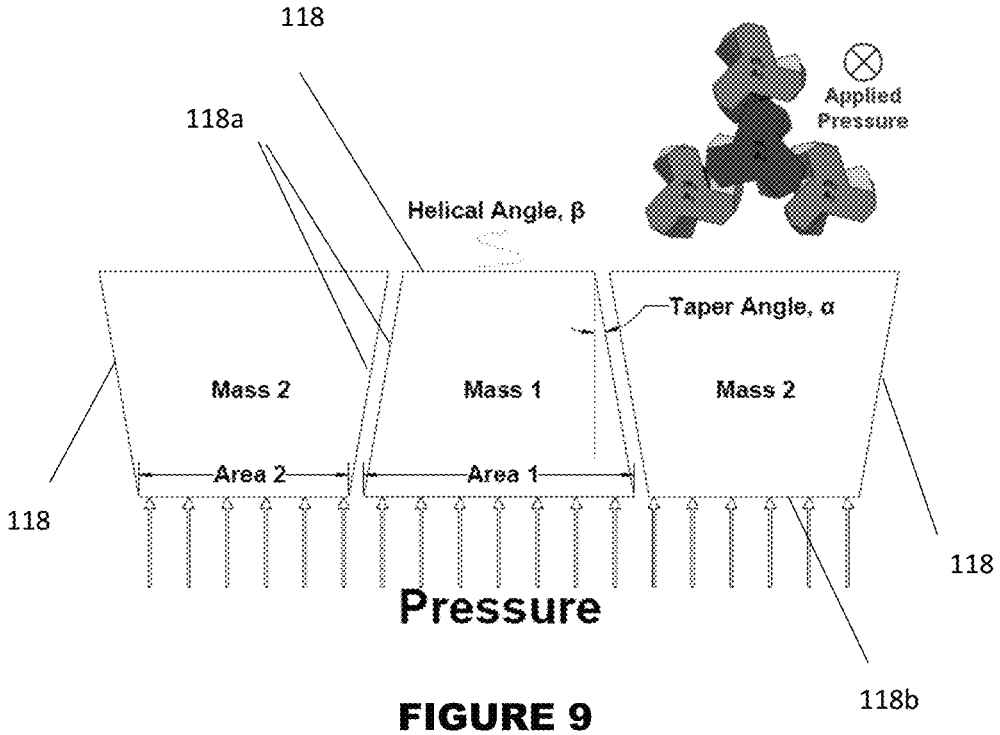
FIG. 9 illustrates a simplified schematic to illustrate pressure load acting on the interior surfaces of preformed fragments.

A simplified dynamic model of the spin inducing formed fragments, FIGS. 7 and 8, is used to calculate a rough estimate of the maximum spin rates that could be achieved with proper fragment geometry and mass distribution. In the utilized model, the fragment is provided with a draft angle ($\alpha$) and a helical angle ($\beta$) (FIG. 9). The draft angle is implemented to enable the preformed fragments to properly mate, and to vary the interior surface areas to produce the spin inducing torques on the fragments 118 as they move outward by the internal pressure of round detonation as described in the previous section. The model is illustrated in FIG. 9 and features two sets of fragments; namely, the fragment 118 located at the center has a mass $m_1$ and an interior surface area $A_1$ and the surrounding fragments 118 are identical with a mass $m_2$ and an interior surface area $A_2$.

It is appreciated that the dynamics of detonation and the interaction of the formed fragments as they are forced out radially and the mechanism and the process of inducing fragment spin, considering the complex surface interactions due to high pressure levels and speed of high explosive detonation, is highly complex. However, using the following highly simplified model and dynamic interactions between the formed fragments 118, one can obtain a rough estimate as to what the maximum spin rates that the formed fragment geometries are capable to induce under ideal conditions.

In such simplified calculations, forces acting on each formed fragment 118 is first calculated from their interior given surface areas. In the ideal conditions considered, the amount of time required for the middle fragment (Mass 1) to travel out of the expanding fragmentation layer (6 mm) is calculated, assuming that the surrounding fragments (Mass 2), due to the much smaller forces acting on them, have moved only half the distance during this time period. Then knowing the pitch angle of the contacting helical surfaces 118*a* of the formed fragments 118, the total angular rotation of the Mass 1 during this time period in which the fragments Mass 1 and Mass 2 are in contact is calculated. The resulting spin rate is then calculated by dividing the amount of angular rotation of the fragments Mass 2 by the calculated time duration. It is noted that in these idealized calculations, the dynamic interaction between the fragments and friction forces as well as the actual displacement of the Mass 2 as the Mass 1 leaves the fragmentation layer are neglected, and the calculations are mainly based on kinematics of relative motion between the fragments. As a result, the calculated spin rates are an upper limit that is not expected to be reached due to the above idealizations.

Using the above process and considering the case in which three Mass 2 fragments are in contact with the Mass 1 fragment, an internal detonation pressure of 210 MPa (three times the safety internal pressure testing level of 70 MPa), mass of 0.55 and 0.51 grams for Mass 1 and Mass 2, areas of 16.5 and 11.9 $mm^2$ for Mass 1 and Mass 2, pitch angle of 7 degrees over the 6 mm thickness of the fragmentation layer, the total time of contact between the fragments is first calculated as around 4.5 μs using Newton's second law, which leads to an upper limit of around 4400 Hz spin rate with the assumed ideal conditions.

Also provided are embodiments for enhancing mortar round range via body surface drag force reduction and for increasing the round stability during the flight.

As a fully assembled mortar cartridge is propelled out of the smooth bored mortar barrel, its trajectory is governed by external aerodynamic loads. The aerodynamic force of interest is specifically the drag force, which acts at the center of pressure and is responsible for opposing the forward motion of the mortar round. By minimizing the drag forces exerted on the mortar round, the maximum range of coverage can be significantly enhanced. A passive flow control technique that is often implemented onto the surface of bluff bodies for drag reduction is a pattern of uniquely positioned dimples (a practice commonly found on golf balls).

An asymmetric dimple pattern can also be implemented onto the exterior surface of the shell body to generate a spinning torque to increase the round spin rate along its long axis, therefore increase its stability, thereby enhancing targeting precision. In addition, the mortar fin assembly may be designed with mechanisms that, once a threshold spin rate has been reached for flight stability, a portion of drag producing fins assembly is retracted (or ejected) to reduce drag forces on the fins, thereby reducing the total drag forces acting on the mortar round during the flight.

Figure 10:
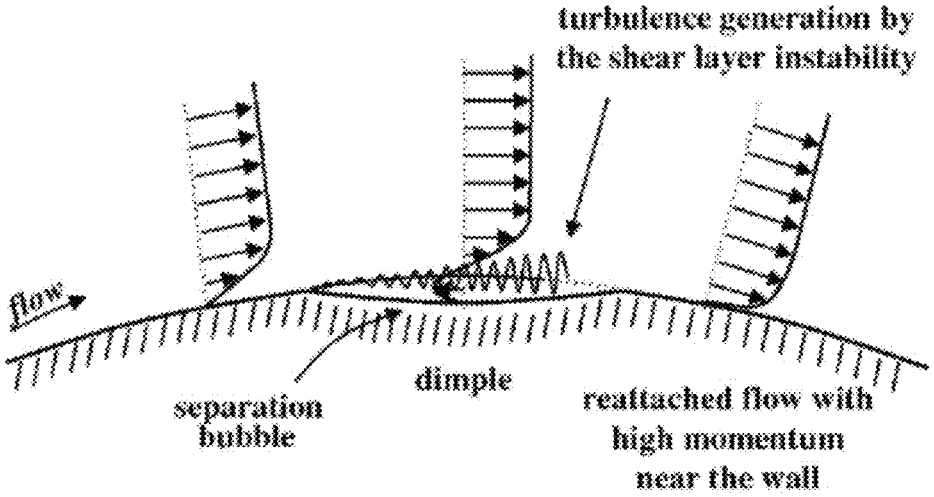
FIG. 10 illustrates the mechanism of drag reduction when dimples are present on an exterior surface of an object in flight.

The significant types of drag forces that act on mortar rounds during the flight are skin and shape drags. The skin drag is completely dependent of the exterior shell body material and the friction as it interacts with the air in flight. Skin drag can be minimized by utilizing computational fluid dynamics and testing different types of carbon-fiber composites to optimize the surface roughness of the exterior shell body structure. The shape drag is caused when the flow of air around the mortar's shape separates and forms what is known as a wake, which results in lower pressures behind the body and more drag. The shape drag may be minimized by implementing an array of dimples on the external surface of the shell body to increase turbulence as the mortar travels in flight. The presence of the dimples induces a turbulent boundary layer on its surface. This turbulent layer flow has a larger momentum compared to laminar boundary layer flow and thus delays flow separation. The presence of dimples is known to reduce the drag coefficient by over 50% in golf balls, but this metric is highly dependent on the diameter and depth of dimples. For golf balls specifically, a nearly constant drag coefficient irrespective of the Reynolds number is due to the last flow separation and reattachment of flow with high momentum near the wall of the ball's surface at an angle of roughly 110°, as shown in FIG. 10. The dimples enable a turbulent layer flow, which delays the flow separation, and ultimately reduces drag on the object in flight.

The exterior surface of the carbon-fiber composite found on the hybrid shell structure can be provided with surface dimples for shape drag reduction. The dimple profile can be properly configured to generate a turbulence boundary layer to achieve shear layer instability. It is known in the art that the drag reduction effect of surface dimples is only observed when shallow dimples were positioned in a staggered pattern. A staggering drag-reducing dimple profile and an aligned drag-inducing profile are shown on FIG. 11. The air flow jumps from a dimple to the next staggered dimple to create an oscillatory path.

Figure 11:
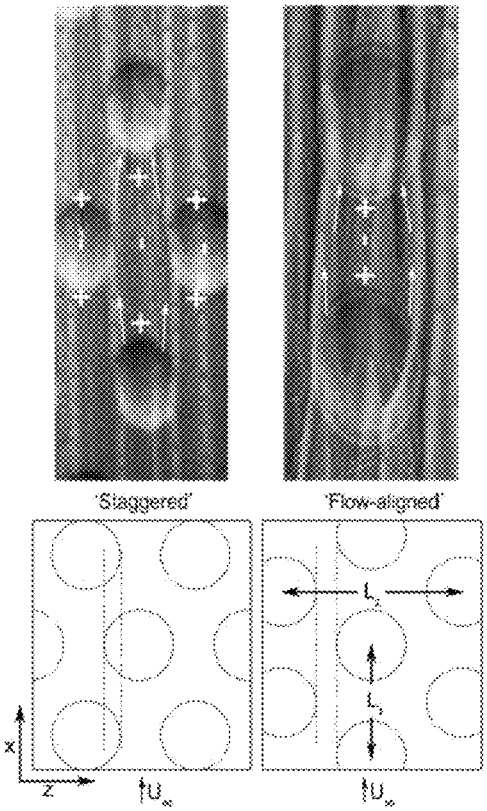
FIG. 11 illustrates a staggered dimpling profile with air flow induced in the positive x-direction and an aligned profile created by rotating the staggered profile by 90°. The indicated (+) and (−) symbols represent region with high and low velocities, respectively.

In FIG. 11 the staggered dimpling profile with air flow induced in the positive x-direction is shown as well as the aligned profile created by simply rotating the staggered profile by 90°. The indicated (+) and (−) symbols represent region with high and low velocities, respectively.

The flow pattern for the aligned dimple profile is shown to have a less oscillatory behavior, and it is this phenomena that allows for the drag reducing mechanism. Based on these direct findings, there is an implication that not all dimple patterns can achieve an intended shape drag reduction. Aside from dimple placement, other considerations that are required include dimple design, the conditions and direction of flow, as well as the skin friction distributions over the coherent structure. Based on these findings, a dimpling pattern is provided which features a staggered pattern placement with a depth to diameter ratio of 0.025, as shown in FIGS. 12.*a* and 12*b*. For a surface dimpling profile with an optimized flow oscillation to enable shape drag reduction, a surface turbulent boundary layer profile shown in FIGS. 13*aad* 13*b* is provided, which significantly reduces the drag forces acting on the mortal round.

Figure 12A:
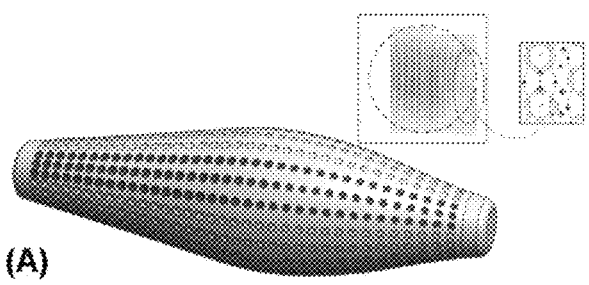
FIGS. 12*a* and 12*b* illustrate a comparison of aligned (FIG. 12*a*) and staggered (FIG. 12*b*) dimpling profile implemented onto the exterior surface of a mortar round.
Figure 12B:
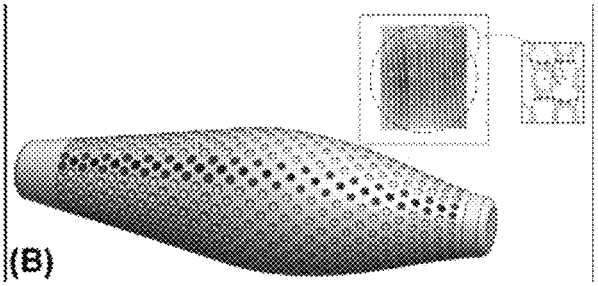

FIGS. 12*a* and 12*b* illustrate a comparison of aligned (FIG. 12*a*) and staggered (FIG. 12*b*) dimpling profile implemented onto the exterior surface of a mortar round.

Figure 13A:
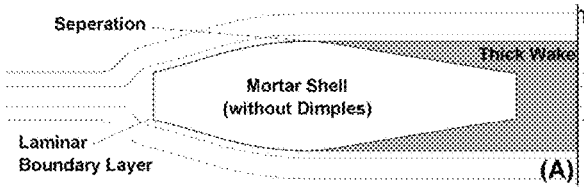
FIGS. 13*a* and 13*b* illustrate boundary layer separation and wake for a mortar without any dimpling (FIG. 13*a*), and with an optimized dimpling profile to enable shape drag reduction (FIG. 13*b*).
Figure 13B:
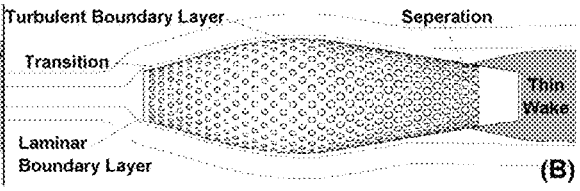

FIGS. 13*a* and 13*b* illustrate boundary layer separation and wake for a mortar without any dimpling (FIG. 13*a*), and with an optimized dimpling profile to enable shape drag reduction (FIG. 13*b*).

Figure 14:
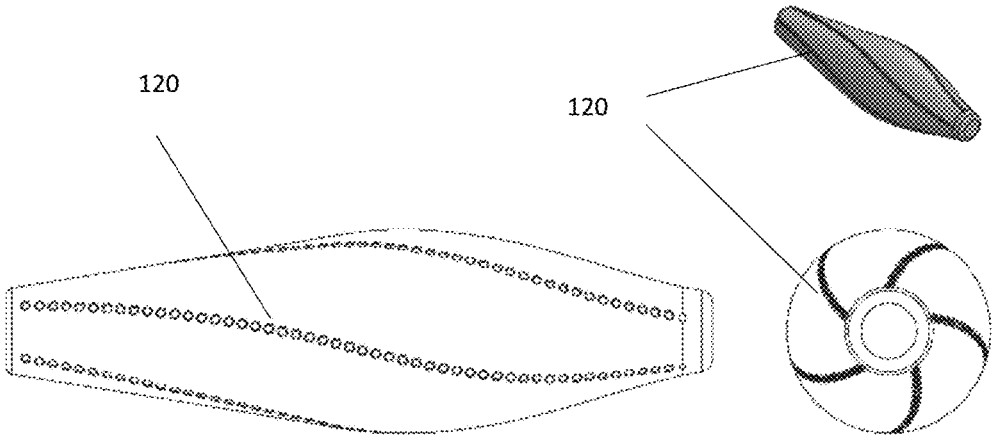
FIG. 14 illustrates an asymmetric dimple profile for stabilizing a fully assembly cartridge by inducing a spinning torque.

Mortar rounds have prescribed spin rate and stability achieved entirely by drag producing fins. However, the round in-flight stability can be enhanced by incorporating asymmetric longitudinal dimple profile patterns designed to induce a spinning torque. An example of such a configuration with a rifling profile is shown in FIG. 14. Due to the complex nature of the interaction of the flow structure and the external surface of the shell body, an optimal asymmetric rifling dimple profile 120 is provided for a net torque generation.

A second type of passively controlled asymmetric feature can also be provided on the mortar fins, such as offset fins.

The fin assembly of a mortar round is provided for flight stability by providing tail drag forces that are needed to stabilize the round at its maximum angular deviation from its flight path at the barrel exit. Once the round flight is stabilized, a significantly lower tail drag force is needed to keep the round stable and keep the wobbling below a specified level and counter all environmental effects such as gusts and cross-flows. Thus, once the mortar flight is stabilized, the total drag forces acting on the round can be reduced by retracting or discarding a portion of the drag producing surfaces of the fin. Since the round can be provided with means of achieving certain spin rate for stability to achieve targeting precision, it can also be provided with passive mechanisms to retract or discard a portion of the drag producing surfaces when a spin rate threshold has been reached.

The mortar is a muzzle loaded weapon system that requires the mortar to slide down a smooth bore before striking a firing pin located at the base of the tube to detonate the cartridge. The ring deforms to seal the propellant gases, reduce dispersion, and ensures repeatable muzzle velocities to create an efficient propulsion system. Obturating rings found on modern mortar rounds are constructed of an amorphous thermoplastic polymer known as polycarbonate and are assembled onto the shell body as a split ring. In the prior art, the obturating ring assembly is fitted and secured onto the shell body assembly by performing ultrasonic welding, a process that allows for plastics to be joined with metal.

The muzzle velocity can be optimized to further extend the range of effective coverage by improving upon the conventional plastic polycarbonate by compounding it with solid lubricants such as molybdenum disulfide ($MoS_2$), polytetrafluoroethylene, or graphite. Materials compounded with solid lubricants are often shown to have a reduced coefficient of friction due to the low interfacial shear strengths between two materials under dry conditions. Polycarbonate compounded with $MoS_2$ has been found to exhibit a lower coefficient of friction, and improve the wear resistant nature between two materials moving relative to each other. The addition of such materials can enhance range by increasing muzzle velocity by reducing friction forces acting on the round in the barrel, while having the added advantage of prolonging the service life of the mortar tubes in the field. For a more readily available and easy to apply material, Vespel, a durable high-performance polyimide-based plastic by DuPont can be used to replace the polycarbonate.

The formed fragmentation geometries and shell configuration discussed above can also be used in the design of artillery rounds and other explosive warheads to achieve higher lethality and prescribed explosive effects.

The formed fragmentation geometries and shell configuration discussed above can also be applied to both military and commercial countermeasure flares and to novel dimple designs for golf balls.

The mortar configurations discussed above has widespread use in countermeasure flares. Among the uses of current countermeasure flares, is to use a thermal signature to "decoy" a heat-seeking missile into tracking and following the flare instead of the aircraft. However, the flares thermal signature, to some extent, cannot be controlled or predetermined. The mortar configurations discussed above can be used not only for expelling a prescribed cloud pattern but also to save internal space, for other payload, such as additional high-explosive material, further increasing a likelihood of a successful defensive countermeasure.

The dimple patterns discussed above for use on the novel mortar design may also have widespread commercial use for golf balls. Instead of using the dimple pattern to promote spin, as discussed above, such research may lead to an application for golf balls that limit spin in one or more predetermined directions (e.g., left and right or "hook" and "slice"). Although such design may not be within PGA rules for professionals, amateur players can use the same recreationally to have a more enjoyable golf playing experience.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A mortar shell comprising:

a polymer outer layer, the polymer outer layer having reinforcing fibers dispersed therein; and a metallic inner layer defining an interior of the mortar, the metallic inner layer having a plurality of metallic fragments, each of the plurality of metallic fragments having a shape to interlock to each of the other of the plurality of metallic fragments, the plurality of metallic fragments being assembled together into the metallic inner layer;

wherein a first metallic fragment of the plurality of metallic fragments having a characteristic different than second metallic fragments surrounding and contacting the first metallic fragment, the first metallic fragment and the second metallic fragments being disposed in a same plane.

2. The mortar shell of claim 1, wherein the characteristic is associated with a speed at which the plurality of metallic fragments are expelled radially outward from the mortar shell after detonation.

3. The mortar shell of claim 1, wherein the characteristic is a surface area facing radially inward towards a center of the mortar round and the first metallic fragment has a greater surface area than the second metallic fragments.

4. The mortar shell of claim 1, wherein the characteristic is a weight and the first metallic fragment has a lighter weight than the second metallic fragments.

5. The mortar shell of claim 1, wherein the plurality of metallic fragments are assembled together along side surfaces of the plurality of metallic fragments, the side surfaces having a taper relative to a plane orthogonal to a top and bottom surface of the plurality of metallic fragments.

6. The mortar shell of claim 5, wherein the first metallic fragment has a first taper along side surfaces of the first metallic fragment, the second metallic fragments having side surfaces contacting the side surfaces of the first metallic fragment having a second taper opposite to the first taper.

7. The mortar shell of claim 1, wherein the first metallic fragment is configured to spin in a direction different from a direction that the second metallic fragments spin when expelled radially outward from the mortar shell after detonation.

8. The mortar shell of claim 1, further comprising an inner layer where the plurality of inner metallic layer is sandwiched between the inner layer and the polymer outer layer.

9. The mortar shell of claim 1, where the polymer outer layer comprises a pattern of dimples formed on an outer surface.

10. The mortar shell of claim 9, wherein the pattern of dimples is configured to rotate the mortar shell after being fired.

11. The mortar shell of claim 9, wherein the pattern of dimples comprises dimples staggered relative to each other.

* * * * *